US006413125B1

(12) United States Patent
Duer

(10) Patent No.: US 6,413,125 B1
(45) Date of Patent: Jul. 2, 2002

(54) CANOE AIR PROPULSION MACHINE

(76) Inventor: Zbigniew Eugeniusz Duer, 243 Bassett St., New Britain, CT (US) 06051

( * ) Notice: Subject to any disclaimer, the term of this patent is extended or adjusted under 35 U.S.C. 154(b) by 0 days.

(21) Appl. No.: 09/794,977

(22) Filed: Feb. 28, 2001

(51) Int. Cl.[7] ..... B63H 7/00
(52) U.S. Cl. ..... 440/37
(58) Field of Search ..... 440/37, 6

(56) References Cited

U.S. PATENT DOCUMENTS 2,987,281 A * 6/1961 Schurr et al. ..... 440/37
3,791,333 A * 2/1974 Losch ..... 440/37
4,322,208 A * 3/1982 Kelpin ..... 440/37

FOREIGN PATENT DOCUMENTS

GB 436555 * 10/1935 ..... 440/37

* cited by examiner

*Primary Examiner*—Ed Swinehart

(57) ABSTRACT

A machine for air propulsion of small watercraft, such as a canoe, comprising of a direct current motor (10) driving an air propeller (20) at reduced rotational speeds for maximum efficiency and quiet operation. The machine comprises:

two sections (22L) and (22R) of propeller guard (22)

machine frame (27)

air propeller (20)

support structure (46)

steering rod (37)

All these major components are easily assembled and disassembled by tightening and removing appropriate wing nuts, allowing easy transportation. The two sections of propeller guard (22) can be attached in the canoe itself and the rest of the machine's components can be easily placed in the trunk of a car.

3 Claims, 4 Drawing Sheets

CANOE AIR PROPULSION MACHINE

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

This invention relates to a propulsion machine comprising an air propeller, for propelling small watercrafts, such as a canoe.

2. Prior Art

The market offers very limited number of options available for power propulsion of small watercrafts and canoes. There are electric trolling motors and small outboard gasoline engines. There are also air propelled watercrafts available, but these employ large horsepower engines that drive relatively small air propellers, creating a noise level comparable to that of an aircraft, which is a major drawback.

The use of water propellers is very difficult or impossible in shallow and weeded waters and it also destroys the aquatic vegetation. Gasoline engines are loud, pollute the environment and are too heavy for canoes.

BRIEF SUMMARY OF THE INVENTION

The principle object of this invention is to provide a machine for propulsion of a canoe or other small watercraft comprising of an air propeller powered by an electric direct current motor. Such a machine eliminates problems associated with water propellers and gasoline engines. It enables one to go over shallow and weeded waters, does not pollute the environment and it creates low level of noise, allowing two persons to converse easily.

Another object of this invention is to provide a machine that can be disassembled quickly and easily for transportation.

To accomplish these objectives the rotational speed of the air propeller is reduced so that the revolving propeller creates a level of noise that is not tiring to the operator. Because of the low rotational speed of the propeller, the size of the air propeller is increased appropriately resulting in high efficiency of the propeller. Also major components of the machine are easily assembled and disassembled without using any tools, thus making it easy to transport.

BRIEF DESCRIPTION OF THE SEVERAL VIEWS OF THE DRAWINGS

In the drawings, closely related parts have the same number but different alphabetic suffixes.

REFERENCE NUMERALS IN DRAWINGS

Figure 1:
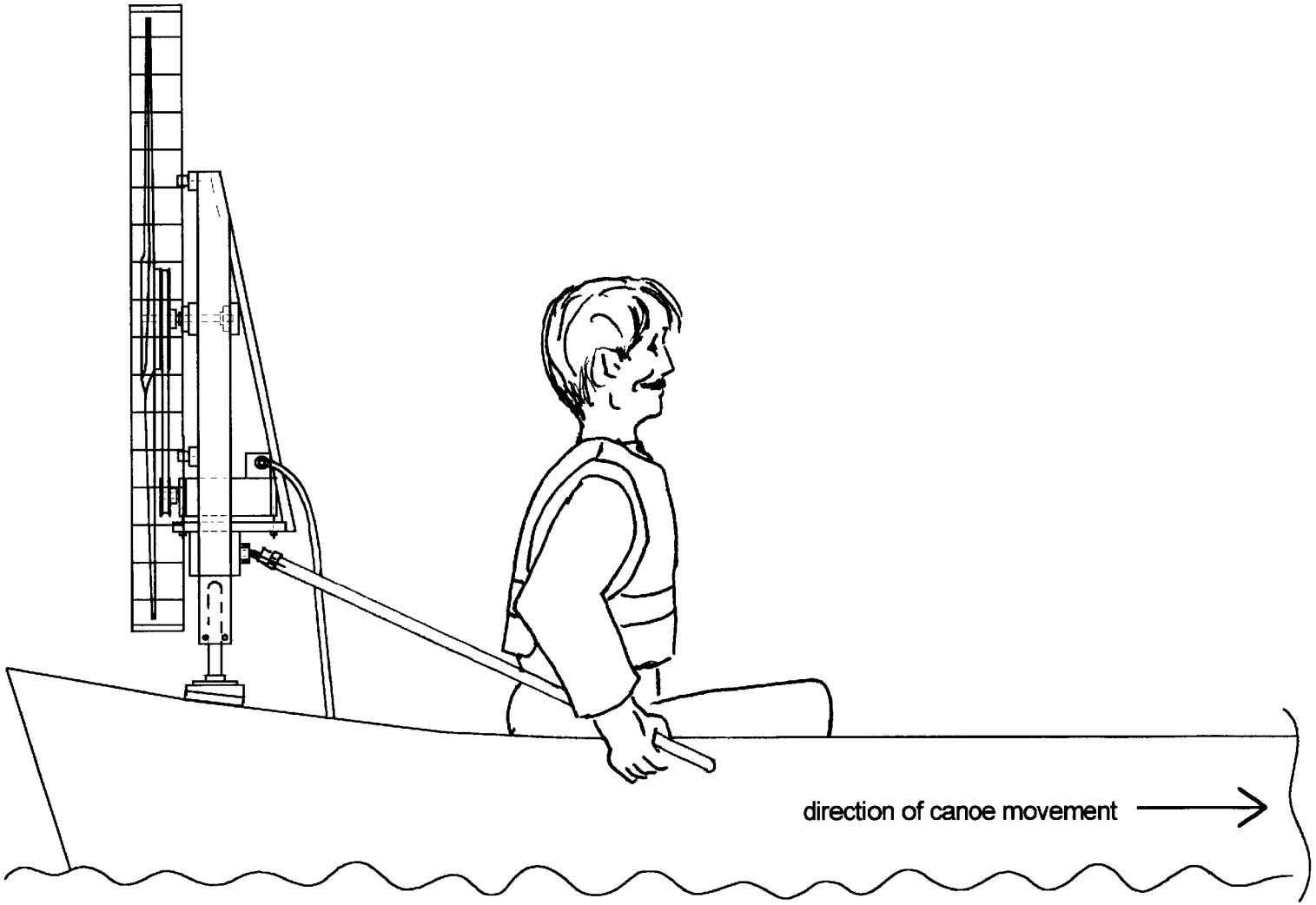
FIG. 1 shows preferred placement of the propulsion machine in relation to a canoe.
Figure 2:
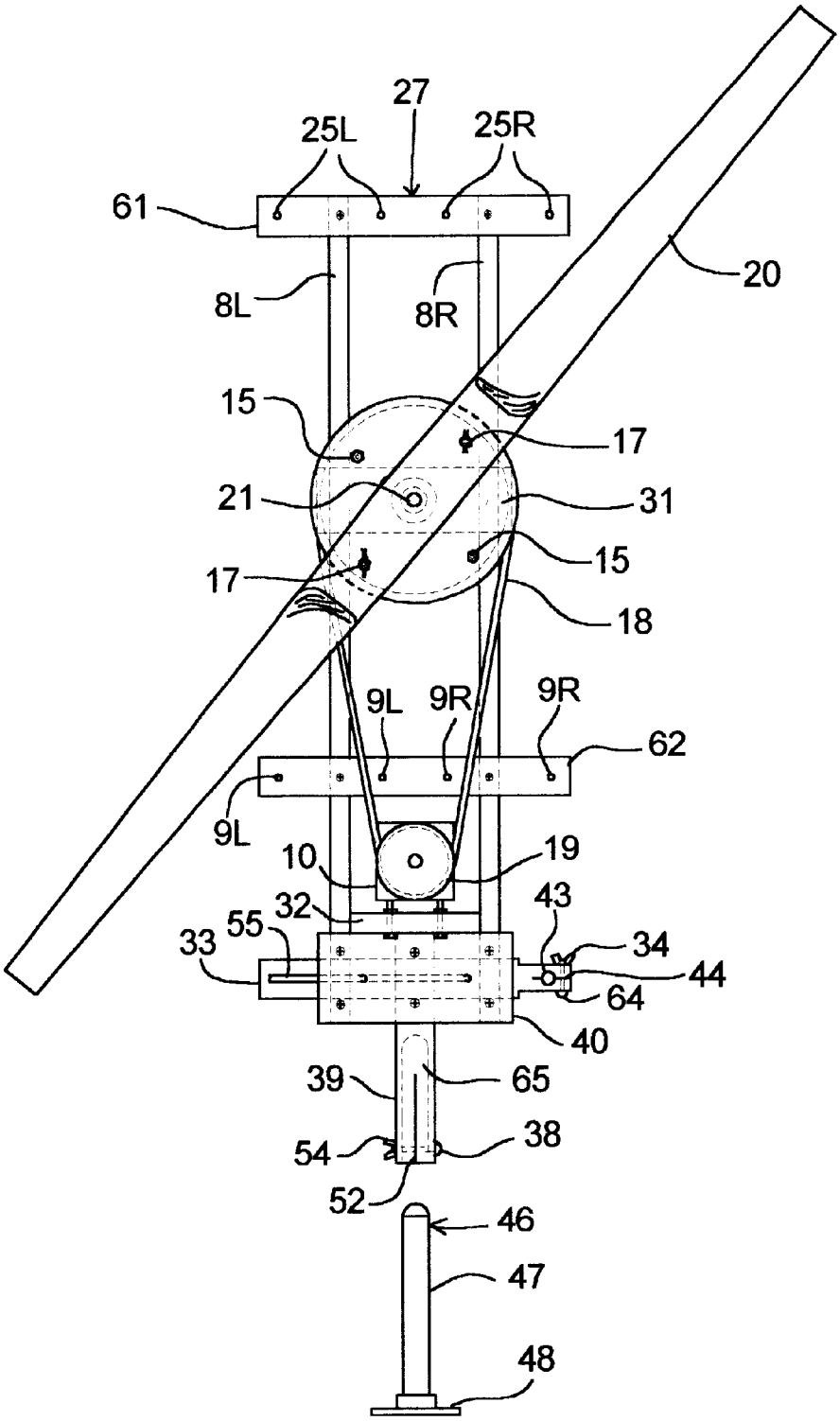
FIG. 2 is a front view of the machine without propeller guard.
Figure 4:
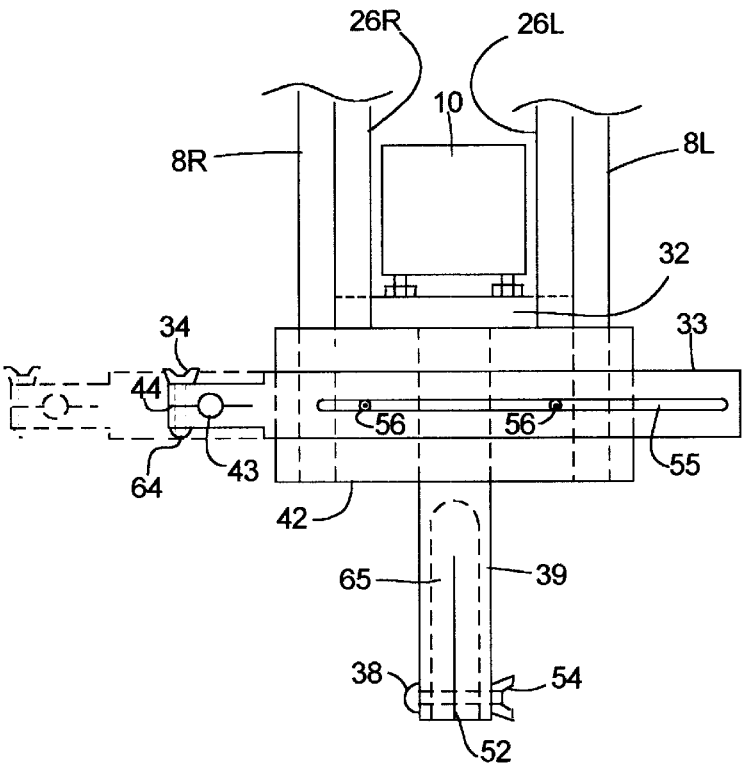
FIG. 4 is a back view of the machine's frame showing steering arm in a greater detail.
Figure 3:
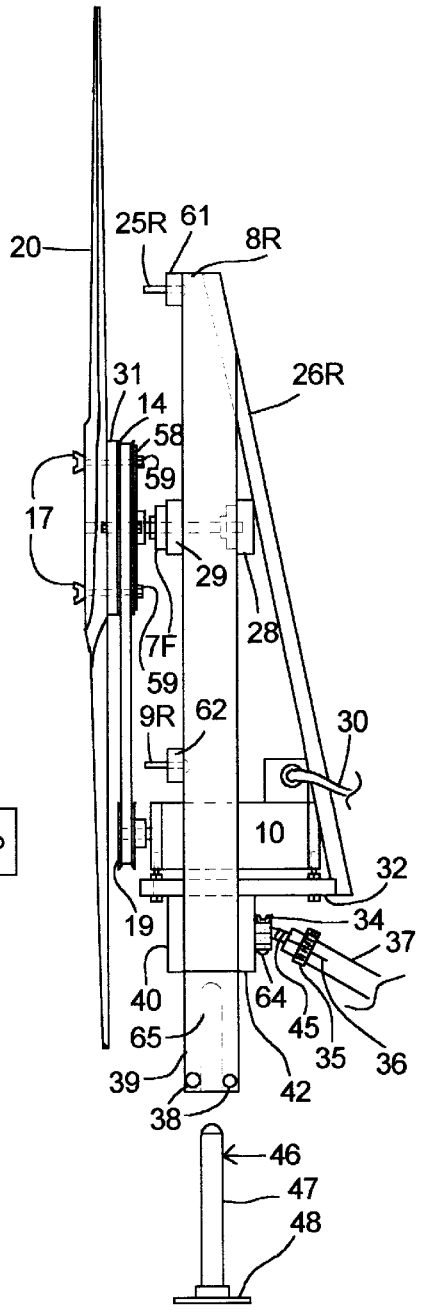
FIG. 3 is a side view of the machine without propeller guard.

| | |
|---|---|
| 6L | through-hole |
| 6R | through-hole |
| 7F | ball bearing pillow block 7B |
| 7B | ball bearing pillow block |
| 8L | vertical frame member |
| 8R | vertical frame member |
| 9L | carriage bolt |
| 9R | carriage bolt |
| 10 | motor |
| 11L | through-hole |
| 11R | through-hole |
| 13L | propeller guard carrying member |
| 13R | propeller guard carrying member |
| 14 | sheave |
| 15 | bolt nut |
| 16 | through-hole |
| 17 | wing nut |
| 18 | v-belt |
| 19 | sheave |
| 20 | propeller |
| 21 | shaft |
| 22 | propeller guard |
| 22L | left section of propeller guard |
| 22R | right section of propeller guard |
| 23L | propeller guard carrying member |
| 23R | propeller guard carrying member |
| 24 | steel rod |
| 25L | carriage bolt |
| 25R | carriage bolt |
| 26L | diagonal frame member |
| 26R | diagonal frame member |
| 27 | frame |
| 28 | frame member |
| 29 | frame member |
| 30 | electrical cord |
| 31 | spacer block |
| 32 | motor's platform |
| 33 | steering arm |
| 34 | wing nut |
| 35 | clamp |
| 36 | slit |
| 37 | steering rod |
| 38 | carriage bolt |
| 39 | main vertical frame member |
| 40 | frame member |
| 42 | frame member |
| 43 | through-hole |
| 44 | slit |
| 45 | swivel connector |
| 46 | support structure |
| 47 | support structure member |
| 48 | flange |
| 49 | through-hole |
| 52 | slit |
| 54 | wing nut |
| 55 | cutout |
| 56 | carriage bolt |
| 58 | back plate |
| 59 | bolt |
| 61 | frame member |
| 62 | frame member |
| 64 | carriage bolt |
| 65 | bore |

DETAILED DESCRIPTION OF THE INVENTION

As shown in the drawings, the canoe air propulsion machine comprises of a frame 27, support structure 46, steering rod 37, air propeller 20, and two sections of propeller guard 22. All these major components of the machine are assembled and disassembled by tightening and removing fastening members. In the preferred embodiment of the invention the fastening member is a wing nut, and frame 27 and propeller 20 are made out of hardwood.

Further, the machine comprises of a device for providing rotational energy at reduced rotational speeds, said device having an output shaft 21 and comprising a direct current motor 10 with an electric cord 30 and means for conveying rotational energy from motor 10 to air propeller 20. Further, the machine comprises of means for rotating the machine on its support structure 46, comprising of a movable steering arm 33, steering rod 37 and swivel connector 45 that connects rod 37 and arm 33.

Means for rotating the machine on its support structure 46 comprises of a movable steering arm 33, steering rod 37 and a swivel connector 45 that connects rod 37 and arm 33.

Means for conveying rotational energy from motor 10 to air propeller 20 comprises of a motor's sheave 19, sheave 14 and v-belt 18 which connects these two sheaves.

Frame 27 comprises of two vertical frame members 8L and 8R. All horizontal frame members are screwed onto these two vertical members with wood screws. In front of and at the bottom of members 8L and 8R a member 40 is screwed. In the back of and at the bottom of members 8L and 8R a member 42 is screwed.

To the top of members 40 and 42 a motor's platform 32 is screwed down and is further secured with two diagonal frame members 26L and 26R that span the end of motor's platform 32 and the tops of members 8L and 8R.

The width between members 8L and 8R is determined by the width of motor's platform 32 that fits snugly between these two members.

To motor's platform 32, 24V direct current motor 10 is secured by means of bolts and nuts (not shown).

Above motor 10 a frame member 62 is screwed to the front of members 8L and 8R. In front of and at the top of members 8L and 8R a frame member 61 is screwed.

There are four carriage bolts 9L and 9R of equal size mounted through member 62 and there are four carriage bolts 25L and 25R of the same size mounted through member 61. These eight bolts protrude out of members 62 and 61 enabling installation of propeller guard 22, which is fastened between frame 27 and propeller 20.

Figure 5:
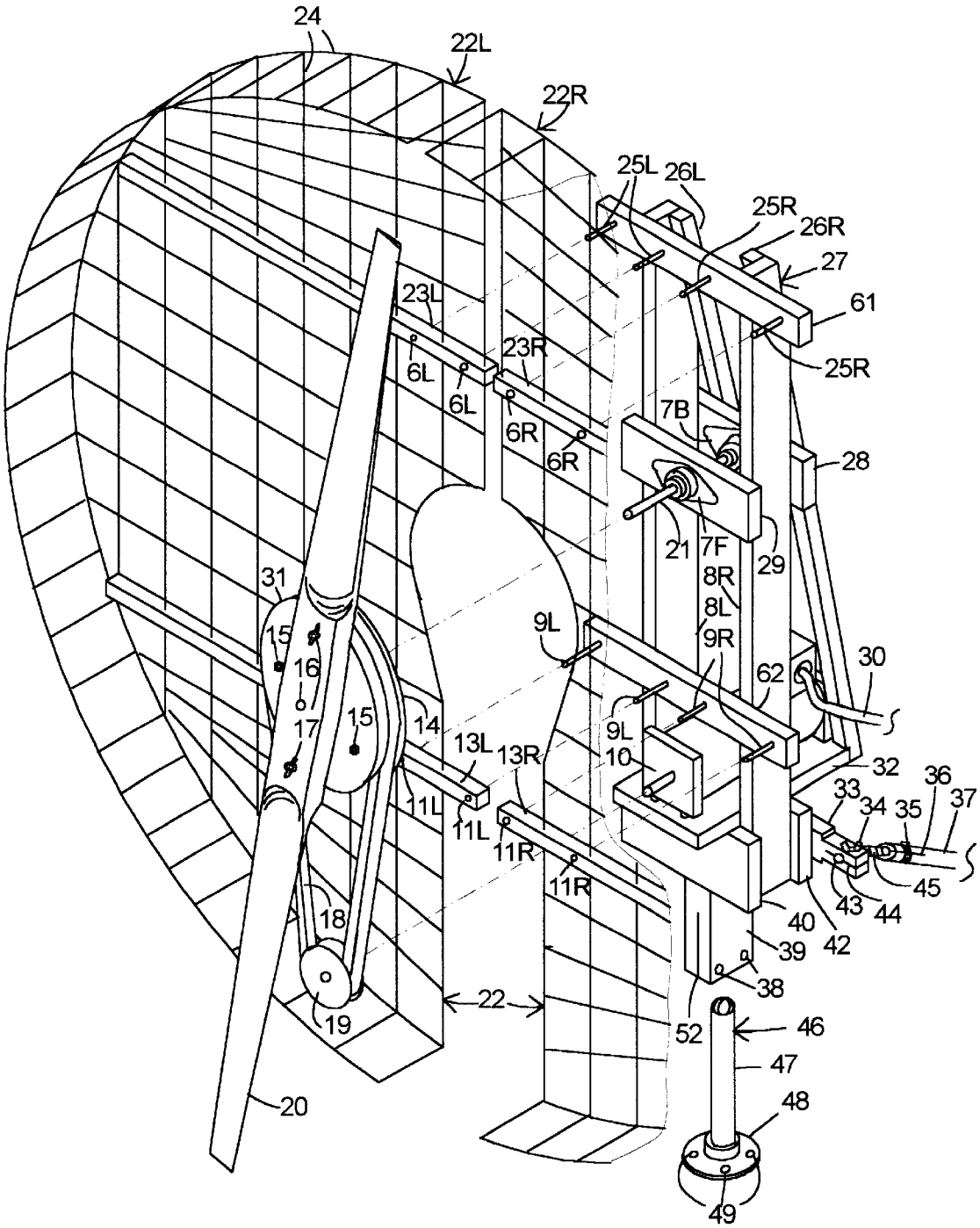
FIG. 5 is a prospective and exploded view of the machine including propeller guard.

Propeller guard 22 comprises of four propeller guard carrying members 13L, 13R, 23L, 23R and steel rods 24 assembled in a pattern as shown in FIG. 5 and brazed together. Propeller guard 22 consists of a left section 22L and a right section 22R.

Left section 22L comprises of propeller guard carrying member 13L which has two through-holes 11L and propeller guard carrying member 23L which has two through-holes 6L.

Right section 22R comprises of propeller guard carrying member 13R which has two through-holes 11R and propeller guard carrying member 23R which has two through-holes 6 R. These eight through-holes are of equal size and are slightly larger in diameter than the corresponding bolts 9L, 9R, 25L and 25R.

When attaching left section 22L to frame 27, members 13L and 23L slip over four bolts 9L and 25L and then are fastened with four wing nuts (not shown).

When attaching right section 22R to frame 27, members 13R and 23R slip over four bolts 9R and 25R and then are fastened with four wing nuts (not shown).

The shape of two sections 22L, 22R permits their assembly and disassembly while all the components of the machine are assembled in their prospective places.

On the front of members 8L and 8R and equally spaced between members 61 and 62, a frame member 29 is screwed. At the same height, on the back of members 8L and 8R, a frame member 28 is screwed.

Both members 28 and 29 have through-holes (not shown) in their centers twice as large in diameter as shaft 21.

Ball bearing, flange pillow blocks 7F and 7B are centered over these two through-holes and are secured with bolts and nuts (not shown), allowing shaft 21 to be inserted perpendicularly to frame members 28 and 29. Shaft 21 protrudes out enough to go through back plate 58, sheave 14, spacer block 31 and propeller 20.

Sheave 14 and spacer block 31 are fastened together utilizing back plate 58; two bolts (not shown) and two bolt nuts 15.

Two additional bolts 59 arc mounted through back plate 58, sheave 14 and spacer block 31. These two bolts protrude out of block 31 enabling installation of propeller 20 that has three through-holes.

Two through-holes are aligned with the two additional bolts that protrude out of block 31 and one through-hole 16 in the center is aligned with shaft 21. Propeller 20 is slipped on to the two bolts that protrude out of spacer block 31 and shaft 21 and is fastened with two wing nuts 17. Back plate 58, sheave 14, spacer block 31 and propeller 20 assembly is secured to shaft 21 by tightening sheave's 14 set screw (not shown) on to shaft 21.

Centered between frame members 8L and 8R and snugly fitted between frame members 40 and 42 a main vertical frame member 39 is screwed to members 40 and 42. The top of member 39 is placed at the bottom of motor's platform 32. At the lower end, along the vertical axis of member 39 a bore 65 is made to allow insertion of support member 47. Member 47 is a piece of brass pipe with a thread (not shown) at one end and a spherical plug (not shown) at the other end. Member 47 is screwed to flange 48 which is fastened to a mounting platform (not shown) of a watercraft with four bolts and nuts (not shown) utilizing four through-holes 49 in flange 48. Only small section of member 47 sticks out of bore 65 when fully inserted into it.

Further, the lower end of member 39 has a slit 52 cut in the middle of it going vertically from the bottom in a plane perpendicular to horizontal members of frame 27 to about 75% of the length of bore 65. Further, frame member 39 consists of two carriage bolts 38 that are installed perpendicularly to slit 52 at the bottom corners of member 39. Wing nuts 54 are screwed on to the ends of these two bolts 38. These two wing nuts 54 and slit 52 provide means for adjusting the resistivity of rotating the machine on its support member 47. These two wing nuts 54 should be tightened enough so there is no vibration while operating the machine, but still they should allow the operator to rotate the machine for steering purposes.

Means for rotating the machine on it's support structure 46 comprises of a steering arm 33 which has a cutout 55, steering rod 37 and swivel connector 45 which is a piece of heavy, tightly coiled spring. Frame member 42 has two carriage bolts 56, mounted through it; protruding outwardly and going through cutout 55 of steering arm 33. Two wing nuts (not shown) are used to tighten arm 33 to member 42. By loosening the wing nuts, arm 33 can be moved to one side until the end of cutout 55 comes to contact with carriage bolt 56. Thus the end of arm 33 will be positioned further from the vertical rotational axis, resulting in easier rotation of the machine, since the force exerted by an operator through steering rod 37 will act on a longer arm.

Arm 33 also comprises of a through-hole 43, slit 44, carriage bolt 64 and a wing nut 34. One end of swivel connector 45 is inserted into through-hole 43 and tightened by wing nut 34. One end of steering rod 37 has a slit 36 and a bore (not shown). The other end of swivel connector 45 is inserted into the bore and tightened by a clamp 35. The distance from an operator to the machine determines the length of steering rod 37.

Operation and Ramifications

To transport the machine, steering rod 37 is removed by loosening wing nut 34. Two sections 22L and 22R of propeller guard 22 are removed by removing eight wing nuts from bolts 9L, 9R, 25L and 25R. By loosening two wing nuts 54, frame 27 can be pulled out of its support structure 46. Propeller 20 can also be removed by removing two wing nuts 17. Thus the whole machine can be easily disassembled and transported even if one transports a canoe on the top of a car. Two sections of propeller guard 22L and 22R can easily be attached inside the canoe, and the rest of the components can easily fit in the trunk of a car.

The machine preferably should be attached at the back end of a canoe, so that an operator has an unobstructed view ahead and is not exposed to a breeze created by the revolving propeller 20. Such an arrangement also allows for using canoe paddles if one chooses to do so.

Power to motor 10 is supplied by conventional deep cycle batteries (not shown) through an appropriate speed control device (not shown) and electrical cord 30. By selecting different speeds through such speed control device, appropriate voltages are applied to motor 10 causing the motor to turn sheave 19 with corresponding rotational speed. In turn sheave 19 through v-belt 18 and sheave 14 turns air propeller 20 with a desired rotational speed and direction. In turn propeller 20 produces a thrust needed for propulsion.

The rotational speed of propeller 20 is reduced about 2.6 times the motor's 10 rotational speed. Thus a relatively large propeller must be employed to utilize the power available from motor 10. This in turn increases efficiency and makes the propeller work quiet enough to prevent noise fatigue to the operator and allowing two persons to converse easily.

However, it must be noted that variations and changes in selecting rotational speeds and sizes of propellers are possible to anyone skilled in the art. Also numerous other minor variations are possible in the constructing and designing of the machine. One such variation would involve a motor coupled directly to an appropriate speed-reducing gearbox and the propeller attached to the output shaft of such speed-reducing gearbox. Also manufactures of direct current motors could construct a motor with lower rotational speed output and thus connect the air propeller to the motor's output directly, although such configuration would require more battery power to achieve the same thrust.

Still another possible variation is to connect a motor directly to an air propeller, although in such configuration the efficiency of a propeller decreases and the noise level increases.

Another variation that one could easily employ is to substitute the wooden frame and wooden propeller with artificial lightweight materials such as plastics and aluminum alloys.

It is obvious that numerous variations, changes and substitutions could be incorporated by those skilled in the art without departing from the invention herein. Accordingly, it is intended that only the spirit and scope of the appended claims limit the invention.

What is claimed is:

1. A machine for air propulsion of a canoe comprising:

(a) a frame comprising of a main vertical member having a bore along the vertical axis of said member, (b) a support structure for said frame, having a vertical shaft member, said shaft member fitting snugly into said bore, allowing said frame to be rotated about the vertical axis of said shaft member, (c) means for adjusting resistivity of rotation of said main vertical member about the vertical axis of said shaft member, allowing said frame to be secured in a fixed, desired position or to be rotated, (d) a device for providing mechanical energy mounted on said frame, having a rotatable output shaft, said device providing rotational energy at reduced rotational speeds to said output shaft, (e) an air propeller mounted to said output shaft, whereby said propeller will produce propulsion and will be revolving with reduced rotational speeds that will allow for verbal communication.

2. A machine for air propulsion of a canoe of claim 1, further including means for rotation said machine on said support structure comprising:

(a) a steering arm mounted on said frame that can be extended to a desired distance from said frame, (b) a steering rod connected substantially perpendicularly to said arm, (c) a swivel connector connecting said rod and said arm, whereby a person in a canoe will be able to move said rod back and forth alongside the canoe to steer the canoe, or to clamp said rod to one side of the canoe in a desired position if one chooses to do so, (d) means for quick attachment of said steering rod to said steering arm by utilizing a fastener.

3. A machine for air propulsion of a canoe of claim 1, further including a propeller guard constructed from wire rods, said guard opened on one side, guarding said propeller from an operator's side, allowing free air movement created by said revolving air propeller comprising:

(a) plurality of sections, each section having plurality of carrying members secured to plurality of wire rods, thereby providing for easy transportation and rigid sections, (b) means for quick attachment of said plurality of sections to said frame by utilizing plurality of fasteners.

* * * * *